US012709455B2

(12) United States Patent
Savalle

(10) Patent No.: US 12,709,455 B2
(45) Date of Patent: Aug. 18, 2026

(54) DEVICE FOR DISPENSING A FLUID PRODUCT COMPRISING A METERING VALVE

(71) Applicant: APTAR FRANCE SAS, Le Neubourg (FR)

(72) Inventor: Matthieu Savalle, Oissel (FR)

(73) Assignee: APTAR FRANCE SAS, Le Neubourg (FR)

( * ) Notice: Subject to any disclaimer, the term of this patent is extended or adjusted under 35 U.S.C. 154(b) by 139 days.

(21) Appl. No.: 18/036,795

(22) PCT Filed: Dec. 2, 2021

(86) PCT No.: PCT/FR2021/052177
§ 371 (c)(1),
(2) Date: May 12, 2023

(87) PCT Pub. No.: WO2022/117961
PCT Pub. Date: Jun. 9, 2022

(65) Prior Publication Data

US 2023/0406606 A1 Dec. 21, 2023

(30) Foreign Application Priority Data

Dec. 4, 2020 (FR) ..... 2012698

(51) Int. Cl.
*B65D 83/52* (2025.01)
*B65D 83/141* (2025.01)
(Continued)

(52) U.S. Cl.
CPC ..... *B65D 83/52* (2013.01); *B65D 83/141* (2025.01); *B65D 83/36* (2013.01); *B65D 83/425* (2013.01); *B65D 83/64* (2013.01)

(58) Field of Classification Search
CPC ..... B65D 83/52; B65D 83/141; B65D 83/36; B65D 83/425; B65D 83/64
See application file for complete search history.

(56) References Cited

U.S. PATENT DOCUMENTS 2,809,774 A * 10/1957 Kaye ..... A47K 5/1201 222/387
3,377,003 A * 4/1968 Bacon ..... B65D 83/64 222/386

(Continued)

FOREIGN PATENT DOCUMENTS

CN 105217166 A * 1/2016
FR 2 692 040 A1 12/1993
FR 2 841 159 A1 12/2003

OTHER PUBLICATIONS

International Search Report for PCT/FR2021/052177, dated Apr. 8, 2022.

(Continued)

*Primary Examiner* — Vishal Pancholi
(74) *Attorney, Agent, or Firm* — Sughrue Mion, PLLC

(57) ABSTRACT

Device for dispensing a fluid product, having a reservoir containing the fluid product and a metering valve having a valve body containing a metering chamber, a valve shut-off element sliding axially in the valve body between an rest position and a dispensing position in order to dispense the contents of the metering chamber. The valve shut-off element is urged towards its rest position by a valve spring, the reservoir containing a follower-piston and a piston spring that axially urges the follower-piston towards the metering valve, the follower-piston being suitable for axially sliding in the reservoir in a sealed manner after each actuation to compensate for the volume of each dispensed dose.

7 Claims, 1 Drawing Sheet

(51) Int. Cl.

| | |
|---|---|
| ***B65D 83/36*** | (2006.01) |
| ***B65D 83/42*** | (2006.01) |
| ***B65D 83/64*** | (2006.01) |

(56) References Cited

U.S. PATENT DOCUMENTS

| | | | | | |
|---|---|---|---|---|---|
| 3,421,664 | A | * | 1/1969 | Eichberg | B65D 83/64 222/340 |
| 4,223,808 | A | | 9/1980 | Williams et al. | |
| 4,877,157 | A | * | 10/1989 | Saulle | B65D 83/64 222/402.1 |
| 5,007,556 | A | | 4/1991 | Lover | |
| 5,065,900 | A | * | 11/1991 | Scheindel | B65D 83/64 222/386 |
| 5,143,259 | A | * | 9/1992 | Williams | B67D 7/0238 222/389 |
| 7,140,518 | B2 | * | 11/2006 | Wang | B05B 9/0838 222/326 |
| 10,543,975 | B2 | | 1/2020 | Friel | |
| 11,523,671 | B2 | * | 12/2022 | Lee | A45D 34/00 |
| 2015/0023885 | A1 | | 1/2015 | Menon et al. | |
| 2015/0232260 | A1 | * | 8/2015 | Dann | B65D 83/206 222/402.1 |
| 2020/0102141 | A1 | | 4/2020 | Leone | |

OTHER PUBLICATIONS

International Preliminary Report on Patentability dated Feb. 9, 2023 in Application No. PCT/FR2021/052177.

* cited by examiner

DEVICE FOR DISPENSING A FLUID PRODUCT COMPRISING A METERING VALVE

CROSS REFERENCE TO RELATED APPLICATIONS

This application is a National Stage of International Application No. PCT/FR2021/052177 filed Dec. 2, 2021, claiming priority based on French Patent Application No. 2012698 filed Dec. 4, 2020.

The present invention relates to a device for dispensing a fluid product comprising a metering valve.

So-called metering valves, in which upon each actuation of the valve, a specific dose of fluid product is dispensed, are well-known in the state of the art, and are generally assembled on a reservoir containing the fluid product and a propellant used to perform the expulsion of the dose.

Two types of metering valves are mainly known.

So-called retention valves comprise a valve shut-off element which, in the rest position, partially closes the metering chamber. More precisely, the outside of the valve shut-off element co-operates in sealed manner with the chamber seal of the metering chamber such that, in the rest position, the metering chamber is connected to the reservoir only via the internal channel of the valve shut-off element.

Metering chambers of "primeless" valves fill only just before actuation proper.

In both configurations, the reservoir is generally filled with the fluid product that is to be dispensed after the metering valve has been assembled on the reservoir, and it is filled through said metering valve.

An important parameter for proper operation of a retention metering valve is to avoid emptying the metering chamber during storage between two actuations, referred to as "drain back", for example because of a vacuum inside the reservoir that may increase after each actuation.

Another difficulty relates to the orientation in which the valve must be used in order to operate reliably. Generally, metering valves must be used in the inverted position, with the reservoir arranged above the valve, so as to guarantee good metering accuracy.

Documents U.S. Pat. No. 5,007,556 and CN105217166 describe devices of the state of the art.

The object of this invention is to provide a device for dispensing a fluid product that does not have the above-mentioned disadvantages.

Thus, the object of the present invention is to provide such a device that limiting or preventing the phenomenon of "drain back".

The present invention also aims to provide such a device that makes it possible an use in all desired orientations.

The present invention also aims to provide such a device that is simple and inexpensive to manufacture and to assemble and that is reliable in use.

The present invention thus provides a device for dispensing a fluid product comprising a reservoir containing the fluid product and a metering valve comprising a valve body containing a metering chamber, a valve shut-off element sliding axially in said valve body between an rest position and a dispensing position, in order to dispense the contents of said metering chamber, said valve shut-off element being urged towards its rest position by a valve spring, said fluid product comprising a liquid formulation made up of one or more active principle(s) in suspension and/or in solution in a liquefied propellant, said reservoir containing a follower-piston which separates said reservoir between an upper reservoir part connected to said metering valve and a lower reservoir part isolated from said metering valve by said follower-piston, said reservoir containing a piston spring which axially urges the follower-piston towards said metering valve, said follower-piston being suitable for axially sliding in the reservoir in a sealed manner after each actuation to compensate for the volume of each dispensed dose.

Advantageously, said follower-piston is axially pushed downwards by said fluid product while it is being filled in said reservoir, such that said follower-piston compresses said piston spring and the air disposed in said lower reservoir part, until the pressures are balanced between said upper reservoir part containing said fluid product in liquid form and said lower reservoir part containing the compressed air and piston spring.

Advantageously, after each actuation, said piston spring pushes said follower-piston axially upwards to compensate for the reduction in volume generated by the dispensing of a dose of fluid product, without any substantial modification in the pressure in said upper reservoir part, so that said fluid product always remains in liquid form.

Advantageously, said piston spring exerts pressure that is suitable for compensating for each decrease in volume after each actuation, but without exerting pressure on said follower-piston that is liable to hinder said reservoir being filled with said fluid product.

The fluid product may be a pharmaceutical, cosmetic, or perfumery product.

Advantageously, said propellant comprises HFA gas, such as HFA 134a and/or HFA 227 and/or HFA-152a.

In a variant, said propellant comprises HFO1234ze.

These characteristics and advantages and others of the present invention appear more clearly from the following detailed description thereof, given by way of non-limiting examples, and with reference to the accompanying drawings, and in which.

Figure 3:
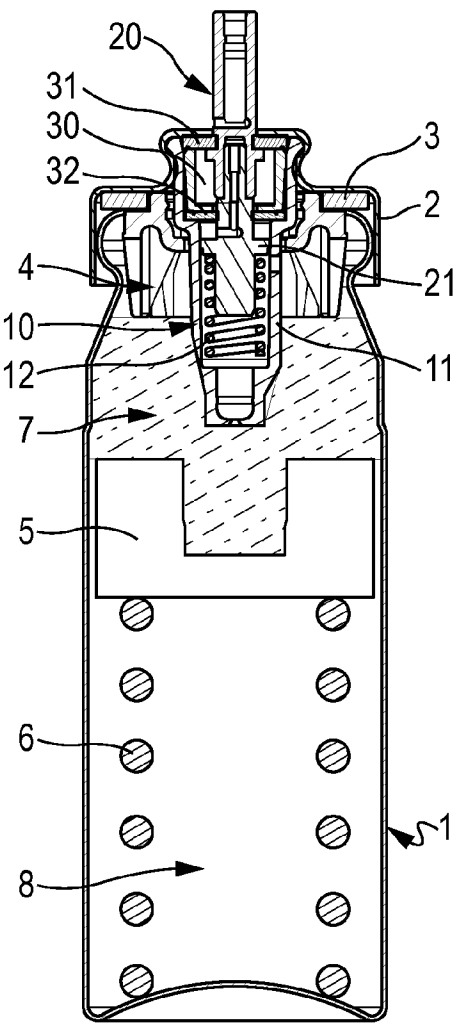
FIG. 3 is a view similar to the view in FIG. 2, in the rest position after several actuations.

In the description below, the terms "top", "bottom", "upper", and "lower" refer to the upright position represented in figures, and the terms "axial" and "radial" refer to the longitudinal central axis of the device.

The device shown in the figures includes a reservoir 1 containing the fluid product, and a metering valve 10. The metering valve is assembled on the reservoir 1, preferably by means of a fastener element 2 that may be a crimpable, screw-fastenable, or snap-fastenable capsule, and advantageously with interposition of a seal gasket 3. Possibly, a ring 4 can be assembled around the body 11 of the metering valve 10, in particular to decrease the dead volume in the inverted position and so as to limit contact between the fluid product and the neck gasket 3. This ring 4 can be of any shape, and the example of figures is not limiting. In general, the reservoir 1 contains the fluid product and the propellant, in particular a liquid formulation made up of one or more active principles in suspension and/or in solution in a liquefied propellant, and possibly excipients. The propellant advantageously comprises an HFA gas, e.g. HFA 134a and/or HFA 227. Preferably, the propellant comprises HFA- 152a. In a variant, other non-harmful gases can be used, such as HFO1234ze. The fluid product contained in the reservoir is thus pressurized.

Figure 2:
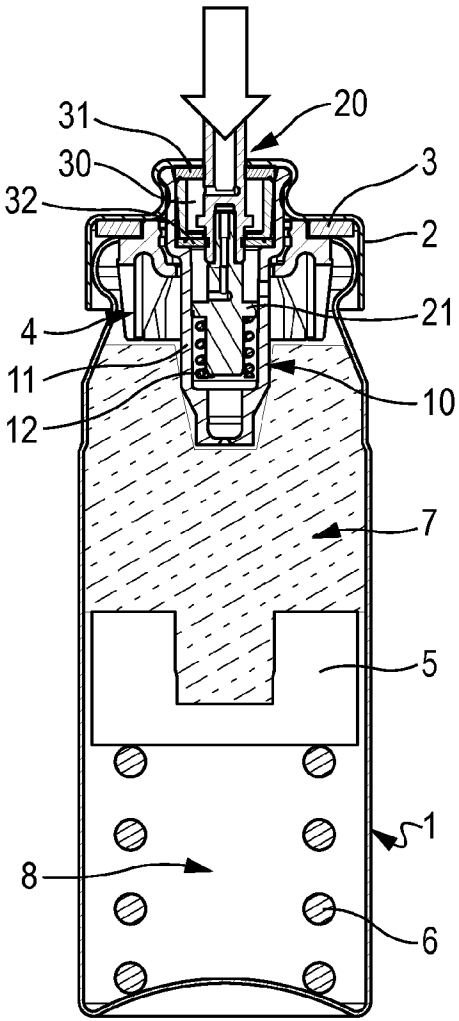
FIG. 2 is a view similar to the view in FIG. 1, during filling the reservoir with fluid product.

The metering valve 10 includes a valve body 11 that extends along a longitudinal central axis. Inside said valve body 10, a valve shut-off element 20 slides between a rest position, that is the position shown in FIG. 3, and a dispensing position in which the valve shut-off element 20 has been pushed into the valve body 10. FIG. 2 represents the valve shut-off element in the dispensing position during filling the reservoir 1 with the fluid product, the filling being performed through the metering valve 10 with the valve shut-off element 20 actuated.

The valve shut-off element 20 is urged towards its rest position by a valve spring 12 that is arranged in the valve body 11 and that cooperates on the one hand with said valve body 11 and on the other hand with said valve shut-off element 20, preferably with a radial collar 21 of the valve shut-off element 20. A metering chamber 30 is defined inside the valve body 11, said valve shut-off element 20 sliding inside said metering chamber 30 so as to enable its contents to be dispensed when the metering valve is actuated.

In known manner, the valve shut-off element 20 may be made of two parts, namely an upper part 31 (also known as a valve shut-off element top) and a lower part 32 (also known as a valve-member bottom).

In conventional manner, the metering chamber 30 is preferably defined between two annular gaskets, namely a valve shut-off element 31, and a chamber gasket 32.

FIG. 3 shows the metering valve in the upright storage position, i.e. the position in which the metering chamber 30 is arranged above the reservoir.

According to the invention, the reservoir 1 contains a follower-piston 5 and a piston spring 6 which urges the follower-piston 5 axially upwards towards said metering valve 10. Thus, the follower-piston 5 is subjected at one side to the pressure exerted on it by the pressurized fluid product, and at the other side to the pressure exerted on it by the piston spring 6. The follower-piston 5 is adapted to slide axially in the reservoir 1 in a sealed manner after each actuation, in order to compensate for the volume of each dispensed dose.

By way of example, the follower-piston 5 may be inserted into the reservoir through an open bottom of the reservoir that is closed after it has been inserted, by fixing an appropriate closure element. In a variant, the insertion could also be performed by an open top of the reservoir followed by fixing a part of the reservoir neck.

Advantageously, the piston spring 6 exerts a low pressure, sufficient to compensate for each decrease in fluid product after each actuation, but without exerting too high a pressure on the follower-piston 5, which could prevent or complicate the filling of the reservoir 1. The choice of the piston spring 6 and of its properties therefore depends on the parameters of the device, such as the dimensions of the reservoir 1, the volume of each dose, the type of formulation, the pressure of the propellant, etc.

Figure 1:
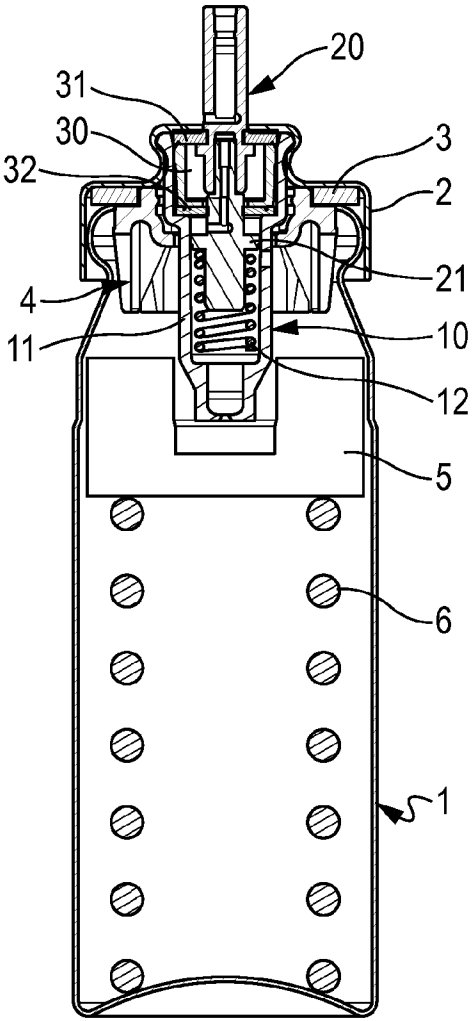
FIG. 1 is a diagrammatic section view of a device for dispensing a fluid product, before having filled the reservoir with fluid product.

Before the reservoir 1 is filled with the fluid product, the follower-piston 5 is therefore pushed by the piston spring 6 close to the metering valve 10, as can be seen in FIG. 1.

During the filling, the fluid product pushes the follower-piston 5 axially downwards, by compressing the piston spring 6 and the air arranged between the follower-piston 5 and the bottom of the reservoir 1, until the pressures are balanced between the upper part 7 of the reservoir containing the fluid product in liquid form and the lower part 8 of the reservoir containing the compressed air and the piston spring 6. The end-of-filling position is shown in FIG. 2.

After each actuation, following the dispensing of a dose of fluid product out of the reservoir, the volume of the upper part 7 decreases, and the piston spring 6 pushes the follower-piston 5 axially upwards to compensate for this decrease in volume without substantial modification of the pressure in the upper part 7 of the reservoir. Thus, the fluid product always remains in liquid form, which eliminates or at least greatly reduces the risks of "drain back".

Another advantage of this implementation is the possibility of actuating the valve in any orientation, since the regulation of the volume and of the pressure in the upper part 7 of the reservoir by the follower-piston and its piston spring 6 makes it possible not only to prevent the "drain back" but also to ensure good filling of the metering chamber 30 after each actuation.

Although the present invention is described above with reference to a particular embodiment thereof, naturally it is not limited by the embodiment shown. On the contrary, any useful modification could be applied thereto by a person skilled in the art, without going beyond the ambit of the present invention, as defined by the accompanying claims.

The invention claimed is:

1. A device for dispensing a fluid product, comprising a reservoir containing the fluid product and a metering valve comprising a valve body containing a metering chamber, a valve shut-off element sliding axially in said valve body between a rest position and a dispensing position, in order to dispense the contents of said metering chamber, said valve shut-off element being urged towards the rest position by a valve spring, said fluid product comprising a liquid formulation made up of one or more active principle in suspension and/or in solution in a liquefied propellant, said reservoir containing a follower-piston which separates said reservoir between an upper reservoir part connected to said metering valve and a lower reservoir part isolated from said metering valve by said follower-piston, wherein said reservoir contains a piston spring which axially urges said follower-piston towards said metering valve, said follower-piston being adapted for axially sliding in said reservoir in a sealed manner after each actuation, in order to compensate for a volume of each dose dispensed, said follower piston being pushed axially downwards by said fluid product when filled in said reservoir, such that said follower-piston compresses said piston spring and air arranged in said reservoir lower part until the pressures are balanced between said upper part of the reservoir containing said fluid product in liquid form and said lower part of the reservoir containing the air and said compressed piston spring; and wherein the fluid product is pressurized by the propellant.

2. The device according to claim 1, wherein, after each actuation, said piston spring pushes said follower piston axially upwards to compensate for a decrease in volume generated by the dispensing of a dose of fluid product, without substantial modification of the pressure in said upper part of the reservoir, such that said fluid product always remains in liquid form.

3. The device according to claim 1, wherein said piston spring exerts a pressure adapted to compensate for each decrease in volume after each actuation, but without exerting a pressure on said follower piston that is liable to hinder the filling of said reservoir with said fluid product.

4. The device according to claim 1, wherein said propellant comprises HFA gas.

5. The device according to claim 1, wherein said propellant comprises HFO1234ze.

6. The device according to claim 1, wherein said propellant comprises one or more of HFA 134a, HFA 227, and HFA-152a.

7. A device for dispensing a fluid product, comprising:

a reservoir containing the fluid product and a metering valve comprising a valve body containing a metering chamber, a valve shut-off element sliding axially in said valve body between a rest position and a dispensing position, in order to dispense the contents of said metering chamber, said valve shut-off element being urged towards the rest position by a valve spring, said fluid product comprising a liquid formulation made up of one or more active principle in suspension and/or in solution in a liquefied propellant, said reservoir containing a follower-piston which separates said reservoir between an upper reservoir part connected to said metering valve and a lower reservoir part isolated from said metering valve by said follower-piston, wherein said reservoir contains a piston spring which axially urges said follower-piston towards said metering valve, said follower-piston being adapted for axially sliding in said reservoir in a sealed manner after each actuation, in order to compensate for a volume of each dose dispensed, said follower piston being pushed axially downwards by said fluid product when filled in said reservoir, such that said follower-piston compresses said piston spring and air arranged in said reservoir lower part until the pressures are balanced between said upper part of the reservoir containing said fluid product in liquid form and said lower part of the reservoir containing the air and said compressed piston spring; and wherein the fluid product is pressurized by the propellant, the propellant provided in the fluid reservoir.

* * * * *